US006101675A

United States Patent [19]

Goldstein

[11] Patent Number: 6,101,675

[45] Date of Patent: Aug. 15, 2000

[54] PIVOTING AND TELESCOPING CURTAIN DUAL-ROD BRACKET FOR BAY WINDOWS

[75] Inventor: Allan Goldstein, New York, N.Y.

[73] Assignee: Source Global Enterprises, Inc., Bronx, N.Y.

[21] Appl. No.: 09/298,891

[22] Filed: Apr. 26, 1999

[51] Int. Cl.[7] ..... A47H 1/04

[52] U.S. Cl. ..... 16/94 D; 16/94 R; 16/90; 16/87 R; 211/105.1; 160/330

[58] Field of Search ..... 16/94 D, 94 R, 16/90, 87 R, 87.4 R; 160/330, 352; 211/105.1, 105.2; 248/251, 261

[56] References Cited

U.S. PATENT DOCUMENTS

| | | | |
|---|---|---|---|
| 2,192,882 | 3/1940 | Muth | 211/105.2 |
| 3,675,883 | 7/1972 | Holmes et al. | 248/251 |
| 4,117,557 | 10/1978 | McPeak et al. | 160/330 |
| 4,671,419 | 6/1987 | Beverly | 211/105.1 |
| 4,694,532 | 9/1987 | Black | 16/94 D |
| 5,018,918 | 5/1991 | Jacobs et al. | 211/105.1 |
| 5,396,740 | 3/1995 | Bocchi | 248/251 |
| 5,803,273 | 9/1998 | Menaged et al. | 211/105.1 |

*Primary Examiner*—Chuck Y. Mah
*Attorney, Agent, or Firm*—Levine & Mandelbaum

[57] ABSTRACT

A wall-mountable curtain rod bracket has two holders for supporting the ends of two respective curtain rods over two adjacent panels of a bay window. Each holder is pivotally mounted on the end of sleeve which is telescopically and rotatably mounted on a segment of an L-shaped rod, which is pivotally mounted on a wall anchor. Set screws are provided for locking all parts after they are pivoted and telescoped to their desired positions.

10 Claims, 2 Drawing Sheets

PIVOTING AND TELESCOPING CURTAIN DUAL-ROD BRACKET FOR BAY WINDOWS

BACKGROUND OF THE INVENTION

This invention relates to holders for curtain rods. More specifically, the invention is directed to apparatus for supporting curtain rods between the panels of a bay window.

It is known in the art to hang curtains in front of a bay window by providing rods which can be pivoted relative to the planes of the glass window panels. The angles between the planes of the panels of bay windows can vary among different bay windows and among panels of the same bay window. Moldings and other wall and window features may not be square with respect to a room's ceiling or floor. Depending on the number of sets of curtains to be hung, the use of other decorative enhancements such as valences and the distance by which moldings project from the surface of the surrounding wall, various linear and angular adjustments may be required in the hanging of one or more sets of curtains over a bay window. Although prior art curtain rod supports exist for allowing adjustment of some of the dimensions which must be varied for successfully hanging curtains in front of a bay window, none is universally adjustable for accommodating virtually all situations.

For example, U.S. Pat. No. 1,591,209 to Boye discloses a curtain rod with hinges provided between sections of the rod for mounting on a bay window.

U.S. Pat. No. 1,375,805 to Umphrey describes a shade and curtain holder having bars with pivoting supports. The rods are mounted on a wall above a window via brackets which can be slid along the bars. Conventional C-shaped curtain rods have cuts to enable them to be bent at the intersections of the rods.

U.S. Pat. No. 5,018,626 to Johnson for a Curtain Rod and End Bracket Assembly discloses the use of connectors to interconnect curtain rod sections which can then be angled to conform to the panels of a bay window. The connectors are made of a resilient synthetic resin material such as polypropylene so that they can be bent without breaking.

U.S. Pat. No. 4,694,532 to Black teaches that several curtain rods may be mounted on a single bracket over a bay window.

The rods are connected at their ends by elbow fittings to change direction for conforming to bay windows.

U.S. Pat. No. 2,192,882 to De Muth discloses a bracket and rod structure for hanging curtains and drapes. De Muth provides for swinging each panel of a pair of curtain panels away from a window, independently of the other panel in a manner which does not appear to be suitable for bay windows.

U.S. Pat. No. 2,229,904 to Sliwa discloses a pivoting curtain rod bracket. Each end of a curtain rod is supported on a separate pivoting bracket. Each rod end can be lifted from its bracket and moved away from the wall on which its bracket is mounted as the bracket supporting the other end pivots outwardly. Curtains or drapes can then be mounted on the rod without having to entirely dismount it. Thereafter the rod can then be pivoted back toward the wall and reconnected to its bracket. Like De Muth, Sliwa discloses a pivoting bracket for a curtain rod which is not, by itself, suitable for hanging curtains in front of a bay window.

U.S. Pat. No. 2,195,979 to Ziolkowski for a curtain drapery support shows the use of pivoting brackets for mounting two curtain rods in parallel. A central locking member joins the ends of two aligned curtain rods, their opposite ends being connected to pivoting brackets mounted on the wall. When a the central locking member is removed, the two segments of the rod can be swung outwardly.

U.S. Pat. No. 4,653,564 to Marocco discloses an angled track for vertical blinds which can be mounted in front of a bay window.

None of the foregoing prior art curtain rod supports provides for supporting adjacent tubular curtain rods in front of a bay window with the number of degrees of movement required to be able to fully adjust the angles and spacing of rods for hanging curtains in front of a bay window.

SUMMARY OF THE INVENTION

The aforementioned problems of the prior art are overcome by the instant invention which provides for a curtain rod bracket which is to be mounted on a wall between two windows which are in intersecting planes. The bracket supports two curtain rods, one for each of the windows. Each of the two curtain rod brackets includes a holder with a hollow cylinder in which the end of a curtain rod is received. Each curtain rod-supporting holder has an extending tab which is fastened by a pivot lock screw to a telescoping cylindrical sleeve. The sleeve is mounted over one segment of an L-shaped rod for telescoping with respect to the rod in order to set the distance of the connected end of the curtain rod from the wall. The opposite leg of the L-shaped rod is situated within an anchor having a flange which is mounted on the wall by screws for pivotal and telescoping movement with respect to the anchor. Set screws are provided for locking all parts after they are pivoted and telescoped to their desired positions.

It is therefore an object of the invention to provide a curtain rod bracket for bay windows which can receive the ends of two respective curtain rods intended to be mounted in adjacent angular disposition.

Another object of the invention is to provide a curtain rod bracket for bay windows.

Still another object of the invention is to provide a curtain rod bracket for bay windows which can secure the ends of two respective curtain rods in variable adjacent angular dispositions relative to the floor or ceiling of a room.

A further object of the invention is to provide a curtain rod bracket for bay windows which can be telescoped toward and away from the windows.

Still a further object of the invention is to provide a curtain rod bracket for bay windows which can be pivoted relative to the planes of the windows.

Other and further objects of the invention will be apparent from the following drawings and description of a preferred embodiment of the invention in which like reference numerals are used to indicate like parts in the various views.

DESCRIPTION OF THE PREFERRED EMBODIMENT

Figure 1:
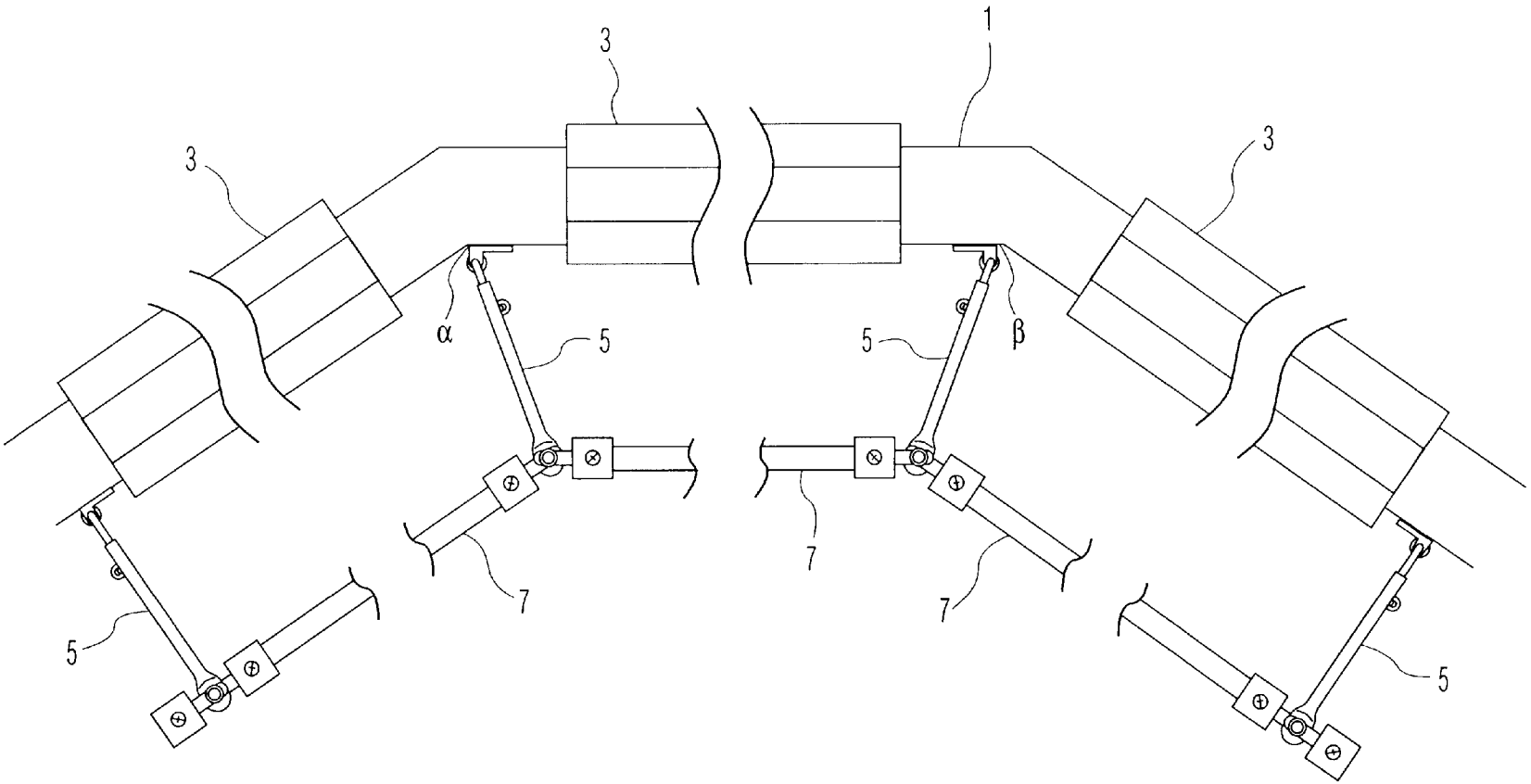
FIG. 1 is a plan environmental view of a pivoting and telescoping curtain dual-rod bracket for bay windows in accordance with the preferred embodiment of the invention.

Referring now to FIG. 1 of the drawings there is shown a plan view of a portion of a room having a bay window 1 with three glass window panels 3. The angles α and β between the plane of the central window panel and each of the side panels 3 are obtuse as is typical in a bay window. These angles are normally intended to be equal although there are usually slight differences between the angles owing to imperfections and building construction.

Mounted on the walls between the three window panels 3 are four curtain rod brackets 5. Each of the central two brackets 5 receives the respective ends of two adjacent curtain rods 7 which are angularly disposed with respect to each other. Each of the outer two brackets 5 receives the end of a single curtain rod 7. The angles between adjacent curtain rods 7, as well as their distances from the window panels 3 that they cover may be adjusted as will be explained hereinafter.

Figure 2:
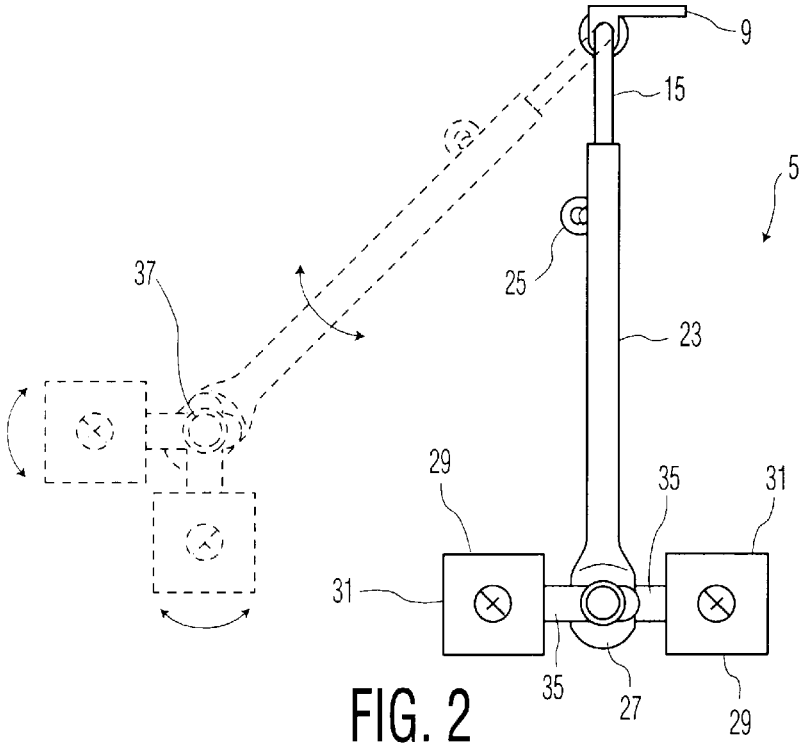
FIG. 2 is a plan view of one of the pivoting and telescoping curtain dual-rod bracket for bay windows shown in FIG. 1 shown in two dispositions, one in solid and the other in phantom.
Figure 3:
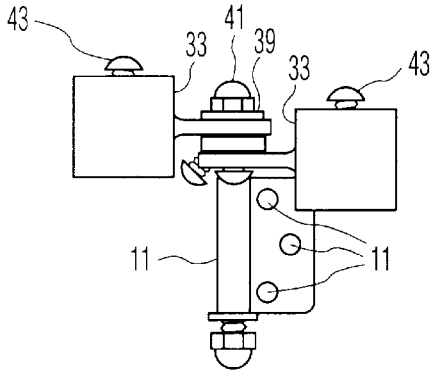
FIG. 3 is an end view of the dual pivoting and telescoping curtain rod bracket for bay windows as shown in FIG. 2.
Figure 4:
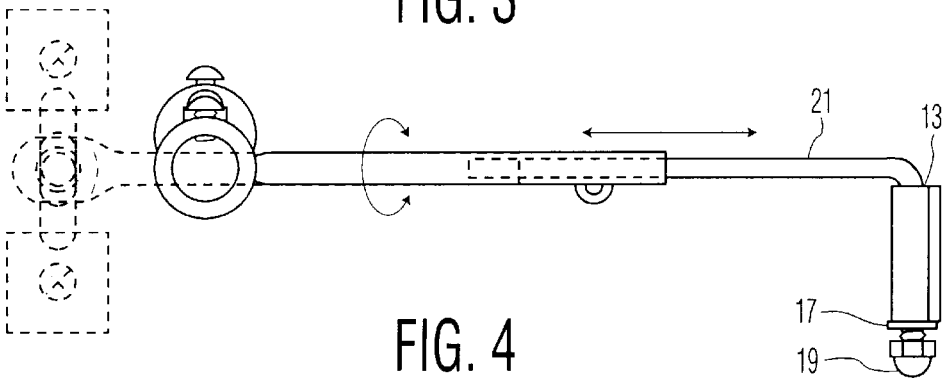
FIG. 4 is a side elevation view of the dual pivoting and telescoping curtain rod bracket for bay windows as shown in FIG. 2.

Referring now to FIGS. 2, 3 and 4 of the drawings there is shown one of the four identical window brackets 5. The bracket 5 has an anchor 8 with a flange 9 in which there are apertures 11 or receiving screws (not shown) to mount the flange 9 on the surface of the adjacent wall as seen in FIG. 1. At one side of the flange 9 is an integral cylindrical boss 11 having a hollow cylindrical bore. Journalled within the bore is a segment 13 of an L-shaped solid rod 15 which is threaded at the free end of the journalled segment to receive a lock washer 17 and nut 19 for securing the rod within the boss 11. The nut 19 can be tightened to fix the position of the rod 15 relative to the flange 9.

When the flange 9 is mounted flush with the surface of a wall, the axes of the boss 11 and the segment 13 of the L-shaped rod 15 are parallel to the surface of the wall and preferably, at least approximately, vertical. The axes of the boss 11 and the rod segment 13 of the L-shaped rod 15 need not be vertical due to the versatility of the bracket 5 as will be apparent.

The free segment 21 of the rod 15 extends outwardly in a direction transverse to the axis of the boss 11. Mounted over the outwardly extending segment 21 of the rod 15 is a cylindrical sleeve 23 having a hollow cylindrical bore with a diameter slightly greater than the diameter of the rod 15 whereby the rod 15 can be received in the sleeve 23 thereby enabling relative movement between the rod 15 and sleeve 23 in both an axial direction for telescoping, and an angular direction for rotation of the ends of the curtain rods 7.

At the end of the sleeve 23 proximate the flange 9 there is a threaded opening in the wall of the sleeve 23 for receiving a set screw 25. The set screw 25 may be loosened to permit relative translation and rotation of the sleeve 23 relative to the rod 15 and then tightened to lock the sleeve 23 and rod 15 together.

The end of the sleeve 23 distal from the flange 9 is flattened to form a platform or base 27 which is provided with a central aperture and on which there are mounted two holders 29 for the ends of adjacent curtain rods 7. Each of the holders 29 includes a cylindrical boss 31 with an axial cylindrical blind opening terminating in a circular of wall 33. Extending axially from an external surface of the circular wall 33 is a tab 35 having a central aperture.

The two holders 29 are mounted on the base 27 of the sleeve 23 by placing their respective tabs 35 on opposite sides of the base 27 with the apertures of the tabs 35 and base 27 in alignment. A screw 37 is passed through the apertures of the tabs 35 and base 27, and a lock washer 39 and nut 41 are fastened to the free end of the screw. The angles of the holders 29 relative to each other and to the sleeve 23 may be adjusted by loosening the nut 41 relative to the screw 37 and then tightening the screw 37 and nut 41 to maintain the desired position. The holders 29 may be rotated relative to the anchor flange 9 by loosening the set screw 25 on sleeve 23 and then tightening it to secure the holders 29 in the desired angular position relative to the flange 9.

In the cylindrical wall of each of the holders 29 there is a threaded aperture for receiving a set screw 43. Each holder's set screw 43 may be loosened to enable a cylindrical curtain rod 7 to be received within the opening in its respective holder and then tightened to secure the end of the curtain rod 7 therein.

It will be seen that adjacent curtain rods 7 received within the holders 29 of a single bracket 5 may be mounted with a desired angle between them, at a desired angle relative to the floor of ceiling, and at a desired angle relative to the wall, by rotating the holders 29 relative to the sleeve 23, rotating the sleeve 23 relative to the rod 15, and rotating the rod 15 relative to the flange 9. The distances of the ends of the rods 7 from the walls adjacent the window panels 3 may also be adjusted by telescoping the sleeves 23 of brackets 5 over their respective rods 15. The locking screws and nuts enable curtains hung on rods 7 to be maintained in a desired position.

It is to be appreciated that the foregoing is a description of a preferred embodiment of the invention to which variations and modifications may be made without departing from the spirit and scope of the invention.

What is claimed is:

1. A curtain rod bracket for a bay window having a first window panel and a second window panel comprising anchoring means adapted to be attachable to the surface of a wall, first telescoping means pivotally mounted on said anchoring means for relative rotation with respect thereto, second telescoping means slidably mounted on said first telescoping means for translation with respect thereto, first holder means pivotally mounted on said second telescoping means and adapted for connection to an end of a first curtain rod, and second holder means pivotally mounted on said second telescoping means and adapted for connection to an end of a second curtain rod, whereby said curtain rod bracket can be mounted on a wall adjacent a region between first and second window panels of a bay window for adjustably supporting adjacent ends of said first and second curtain rods, said first curtain rod being able to support a curtain over said first window panel and said second curtain rod being able to support a curtain over said second window panel.

2. A curtain rod bracket for bay windows according to claim 1 wherein said first telescoping means has at least two segments and said flange means has a hollow bore for receiving one of said segments for rotation therein.

3. A curtain rod bracket for bay windows according to claim 2 further comprising locking means mounted on at least one of said anchoring means and said first telescoping means and selectively engageable with the other of said anchoring means and said first telescoping means for selectively permitting and preventing relative movement of said first telescoping means with respect to said anchoring means.

4. A curtain rod bracket for bay windows according to claim 2 wherein another of said segments of said first telescoping means has a longitudinal axis which is not coaxial with a longitudinal axis of said one of said segments.

5. A curtain rod bracket for bay windows according to claim 4 wherein the longitudinal axis of said one of said segments of said first telescoping means is transverse to the longitudinal axis of said another of said segments of said first telescoping means.

6. A curtain rod bracket for bay windows according to claim 1 wherein one of said first telescoping means and said second telescoping means comprises a hollow tube and the other of said first telescoping means and said second telescoping means comprises a rod slidably received within said tube.

7. A curtain rod bracket for bay windows according to claim 6 wherein said first telescoping means and said second telescoping means have circular cross sections and are rotatable relative to one another about a common axis.

8. A curtain rod bracket for bay windows according to claim 7 further comprising locking means mounted on at least one of said first telescoping means and said second telescoping means and engageable with the other of said first telescoping means and said second telescoping means for selectively permitting and preventing relative movement of said second telescoping means with respect to said first telescoping means.

9. A curtain rod bracket for bay windows according to claim 1 wherein each of said first and second holder means has a cylindrical bore for receiving a cylindrical end of a curtain rod.

10. A curtain rod bracket for bay windows according to claim 9 wherein each of said first and second holder means has a mounting surface with an aperture, said second telescoping means having an end distal from said flange means comprising a mounting surface having an aperture, said apertures in said mounting surfaces of said second telescoping means, said first holder means and said second holder means being in coaxial alignment, and further comprising fastener means disposed within said apertures in said mounting surfaces of said second telescoping means, said first holder means and said second holder means, said second telescoping means, first holder means and second holder means being rotatable relative to one another in a common plane when said fastener means is in a disengaged state and fixed relative to one another when said fastener means is an engaged state.

* * * * *